US008871059B2

(12) United States Patent
Jaakkola et al.

(10) Patent No.: US 8,871,059 B2
(45) Date of Patent: Oct. 28, 2014

(54) METHODS AND APPARATUS FOR FORMING FLUFF PULP SHEETS

(75) Inventors: Jyrki T. Jaakkola, Lawrenceville, GA (US); James E. Sealey, Anderson, SC (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 13/398,144

(22) Filed: Feb. 16, 2012

(65) Prior Publication Data

US 2013/0213594 A1 Aug. 22, 2013

(51) Int. Cl.

| | |
|---|---|
| ***D21F 11/00*** | (2006.01) |
| ***D21F 1/08*** | (2006.01) |
| *D21F 11/14* | (2006.01) |

(52) U.S. Cl.

CPC .. *D21F 1/08* (2013.01); *D21F 11/14* (2013.01)
USPC ..... 162/208; 162/198; 162/203; 162/205; 162/217

(58) Field of Classification Search

CPC ..... D21F 1/08; D21F 3/045; D21F 9/003; D21F 9/006; D21F 11/14; D21H 27/30
USPC ..... 162/9, 28, 100, 109, 123–133, 146, 162/149, 157.1, 157.6, 158, 212, 216, 162/208–210, 351–352, 198, 202–203; 241/21, 28
See application file for complete search history.

(56) References Cited

U.S. PATENT DOCUMENTS

| | | | | |
|---|---|---|---|---|
| 3,395,708 | A * | 8/1968 | Laurence | 604/375 |
| 3,951,736 | A * | 4/1976 | Kobayashi | 162/274 |
| 4,300,981 | A * | 11/1981 | Carstens | 162/109 |
| 4,532,009 | A * | 7/1985 | Nickerson | 162/351 |
| 4,687,549 | A * | 8/1987 | Kallmes | 162/352 |
| 4,948,466 | A | 8/1990 | Jaakkola | |
| 4,999,087 | A * | 3/1991 | Ebihara et al. | 162/301 |
| 5,068,009 | A | 11/1991 | Jokinen et al. | |
| 5,139,861 | A | 8/1992 | Williams et al. | |

(Continued)

FOREIGN PATENT DOCUMENTS

| | | |
|---|---|---|
| DE | 4005281 | 8/1991 |
| DE | 102008041515 | 3/2010 |

(Continued)

OTHER PUBLICATIONS

J. D. Peel, "Paper Science and Paper Manufacture," 1999, Angus Wilde Publications, Inc., pp. 125-158.*

*Primary Examiner* — Jose Fortuna
(74) *Attorney, Agent, or Firm* — Thomas W. Barnes, III

(57) ABSTRACT

Processes for making fluff pulp sheets mechanically eliminate many unwanted fiber-to-fiber bonding (fiber bundles) in the sheet. Pulp slurry is deposited on a moving bottom forming wire to form a stock web. Pulp slurry is brought into contact with a moving top forming wire. The stock web is subjected to up and down dewatering creating separately formed layers to reduce fiber-to-fiber bonding. The stock web can be subjected to strong pulsating shear forces as it is being advanced along the bottom forming wire to break fiber bundles. The pulp slurry can be deposited on the bottom forming wire utilizing a headbox with dilution control to selectively adjust the concentration of the pulp slurry. Shoe presses can be used to dewater the web after it is subjected to the pulsating shear forces.

21 Claims, 4 Drawing Sheets

(56) References Cited

U.S. PATENT DOCUMENTS

| | | | | | |
|---|---|---|---|---|---|
| 5,155,964 | A | | 10/1992 | Fortin et al. | |
| 5,211,814 | A | * | 5/1993 | Jaakkola et al. | 162/301 |
| 5,227,023 | A | * | 7/1993 | Pounder et al. | 162/101 |
| 5,248,392 | A | * | 9/1993 | Bando et al. | 162/301 |
| 5,272,852 | A | | 12/1993 | Fortin et al. | |
| 5,492,759 | A | | 2/1996 | Eriksson et al. | |
| 5,507,918 | A | | 4/1996 | Polifke et al. | |
| 5,536,369 | A | | 7/1996 | Norlander | |
| 5,562,807 | A | * | 10/1996 | Baluha | 162/352 |
| 5,573,642 | A | * | 11/1996 | Begemann | 162/190 |
| 5,582,687 | A | * | 12/1996 | Odell et al. | 162/203 |
| 5,635,028 | A | * | 6/1997 | Vinson et al. | 162/111 |
| 5,690,792 | A | * | 11/1997 | Jaakkola et al. | 162/301 |
| 5,695,613 | A | | 12/1997 | Hentila et al. | |
| 5,707,495 | A | * | 1/1998 | Heinzmann et al. | 162/343 |
| 5,735,330 | A | * | 4/1998 | Buchmann et al. | 162/301 |
| 5,746,889 | A | * | 5/1998 | Huovila et al. | 162/216 |
| 5,759,353 | A | * | 6/1998 | Jaakkola et al. | 162/301 |
| 5,776,308 | A | | 7/1998 | Sears et al. | |
| 5,830,322 | A | * | 11/1998 | Cabrera y Lopez Caram et al. | 162/209 |
| 5,837,627 | A | * | 11/1998 | Halabisky et al. | 442/385 |
| 5,858,172 | A | | 1/1999 | Sears et al. | |
| 5,885,420 | A | * | 3/1999 | Heinzmann et al. | 162/198 |
| 6,030,501 | A | * | 2/2000 | Neun et al. | 162/352 |
| 6,059,924 | A | * | 5/2000 | Hoskins | 162/9 |
| 6,117,272 | A | * | 9/2000 | Heinzmann | 162/216 |
| 6,126,786 | A | * | 10/2000 | White et al. | 162/209 |
| 6,159,335 | A | * | 12/2000 | Owens et al. | 162/9 |
| 6,210,535 | B1 | * | 4/2001 | Huovila et al. | 162/322 |
| 6,270,624 | B1 | * | 8/2001 | Huovila et al. | 162/127 |
| 6,296,737 | B1 | * | 10/2001 | Wu et al. | 162/164.1 |
| 6,458,343 | B1 | * | 10/2002 | Zeman et al. | 424/63 |
| 6,524,442 | B2 | | 2/2003 | Tanner et al. | |
| 6,562,196 | B1 | * | 5/2003 | Huovila et al. | 162/198 |
| 6,562,197 | B2 | * | 5/2003 | Forester | 162/352 |
| 6,773,545 | B2 | | 8/2004 | Tanner et al. | |
| 6,821,383 | B2 | | 11/2004 | Shore et al. | |
| 6,893,473 | B2 | | 5/2005 | Neogi et al. | |
| 6,918,992 | B1 | | 7/2005 | Strandberg et al. | |
| 6,962,646 | B2 | * | 11/2005 | Schwaner et al. | 162/123 |
| 7,141,143 | B2 | * | 11/2006 | Juutinen | 162/208 |
| 7,312,297 | B2 | | 12/2007 | Hamed | |
| 7,399,378 | B2 | * | 7/2008 | Edwards et al. | 162/111 |
| 7,686,921 | B2 | * | 3/2010 | Hamed et al. | 162/157.6 |
| 7,854,822 | B2 | | 12/2010 | Chmielewski et al. | |
| 7,993,492 | B2 | * | 8/2011 | Cabrera Y Lopez Caram | 162/211 |
| 8,070,915 | B2 | * | 12/2011 | Ahmaniemi et al. | 162/199 |
| 8,083,897 | B2 | | 12/2011 | Scherb et al. | |
| 8,236,139 | B1 | * | 8/2012 | Reed | 162/353 |
| 2001/0004928 | A1 | * | 6/2001 | Georger et al. | 162/198 |
| 2001/0037867 | A1 | * | 11/2001 | Huovila et al. | 162/258 |
| 2002/0066546 | A1 | * | 6/2002 | Forester | 162/352 |
| 2003/0183352 | A1 | * | 10/2003 | Schwaner et al. | 162/123 |
| 2004/0099388 | A1 | * | 5/2004 | Chen et al. | 162/134 |
| 2004/0206465 | A1 | * | 10/2004 | Farrington et al. | 162/123 |
| 2005/0039874 | A1 | * | 2/2005 | Halmschlager et al. | 162/298 |
| 2005/0051290 | A1 | * | 3/2005 | Beasley et al. | 162/176 |
| 2006/0283569 | A1 | * | 12/2006 | Wildfong et al. | 162/300 |
| 2007/0158042 | A1 | * | 7/2007 | Raisanen et al. | 162/133 |
| 2007/0163736 | A1 | * | 7/2007 | Raisanen et al. | 162/132 |
| 2007/0270070 | A1 | * | 11/2007 | Hamed | 442/414 |
| 2008/0121360 | A1 | * | 5/2008 | Hietaniemi et al. | 162/130 |
| 2009/0258149 | A1 | * | 10/2009 | Poikolainen et al. | 427/372.2 |
| 2010/0163199 | A1 | * | 7/2010 | Dougherty et al. | 162/181.2 |
| 2011/0030908 | A1 | * | 2/2011 | Sealey et al. | 162/162 |
| 2011/0034891 | A1 | * | 2/2011 | Jiang et al. | 604/358 |
| 2011/0108227 | A1 | * | 5/2011 | Sealey et al. | 162/181.9 |
| 2011/0265968 | A1 | * | 11/2011 | Ruf et al. | 162/341 |
| 2012/0048493 | A1 | * | 3/2012 | Sealey | 162/179 |
| 2013/0213594 | A1 | * | 8/2013 | Jaakkola et al. | 162/123 |

FOREIGN PATENT DOCUMENTS

| | | | | | |
|---|---|---|---|---|---|
| EP | 184603 | A1 | * | 6/1986 | D21C 9/00 |
| JP | 04214495 | A | * | 8/1992 | |
| WO | 9312292 | | | 6/1993 | |
| WO | 9935330 | | | 7/1999 | |
| WO | 2009068728 | | | 6/2009 | |
| WO | WO 2013122731 | A1 | * | 8/2013 | D21F 1/08 |

* cited by examiner

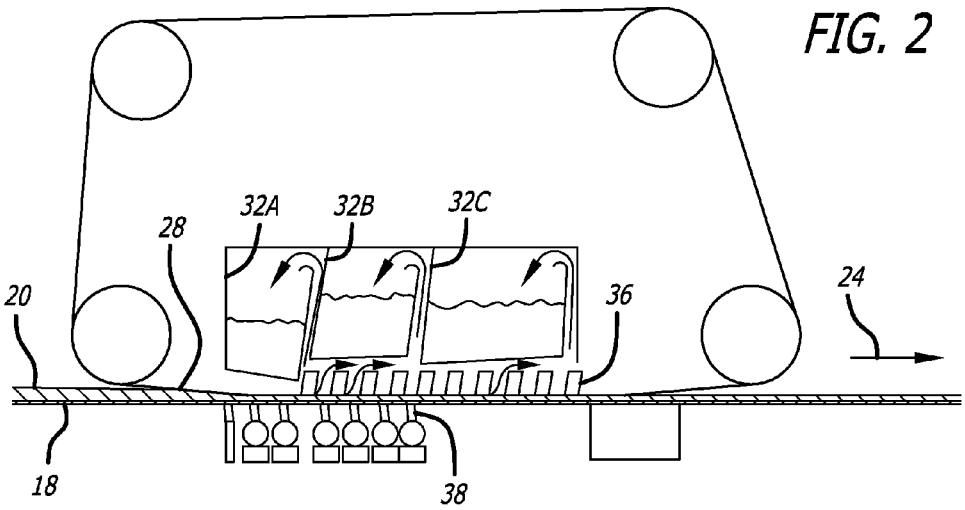
FIG. 2
FIG. 3
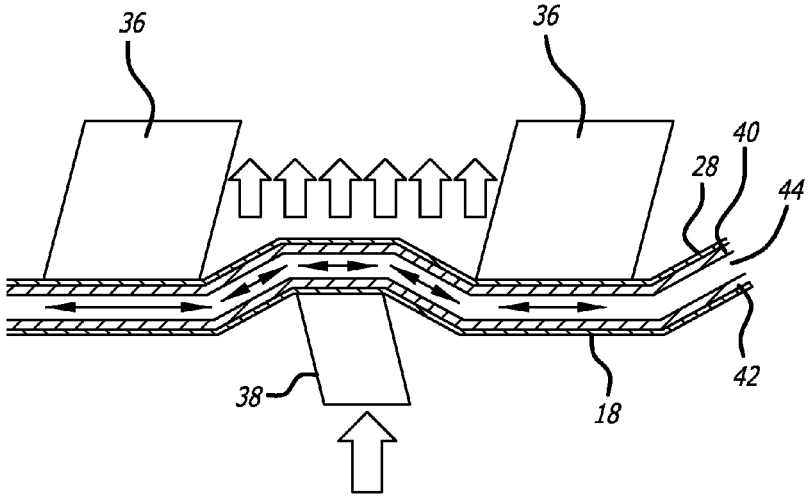

FIG. 6
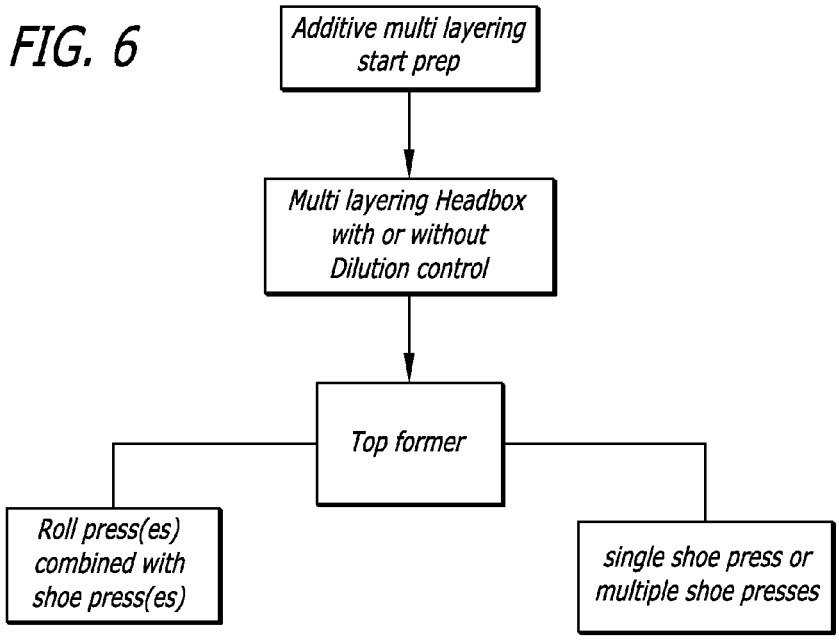
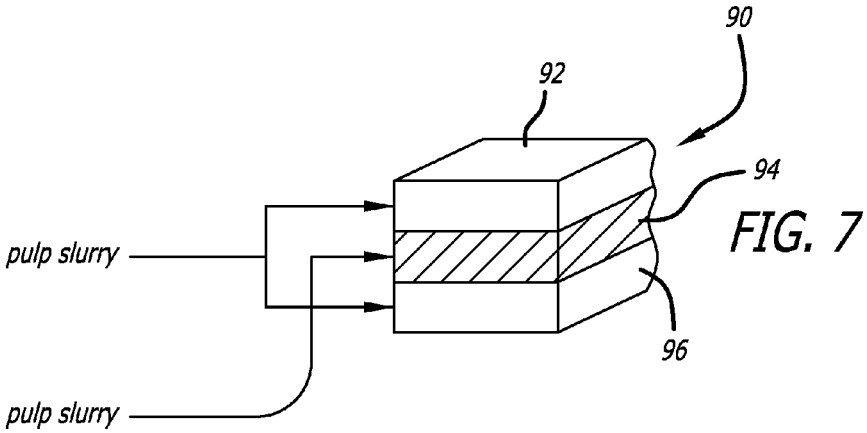
FIG. 7
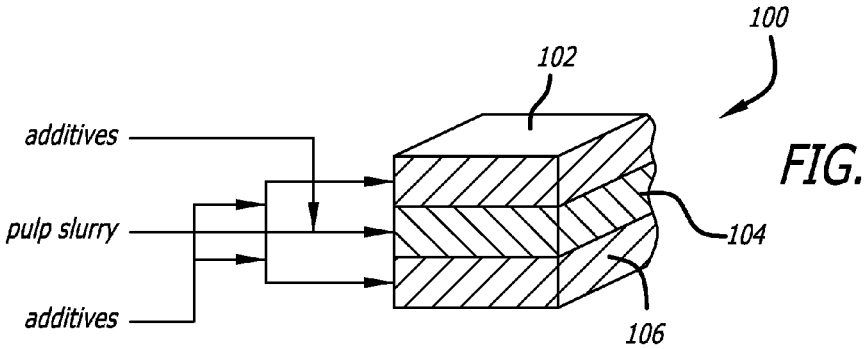
FIG. 8

METHODS AND APPARATUS FOR FORMING FLUFF PULP SHEETS

BACKGROUND OF THE INVENTION

This invention relates generally to wet forming processes for making fluff pulp from soften wood pulps and, more particularly, to improved processes for making fluff pulp sheets which eliminate many of the unwanted fiber-to-fiber bonding (fiber bundles) that may be contained in the sheet to produce consistent and uniform quality fluff pulp. These improved processes also permit the manufacturer to control the consistency of the stock being formed by localized dilution to achieve a better cross-machine directional basis weight allowing the manufacturer to produce high quality fluff pulp while using low headbox consistency. Fluff pulp produced by the processes of the present invention is soft, flexible, and has a lower content of knots or hard spots. The processes of the present invention are capable of producing fluff pulp sheets having low variability in weight, moisture, Mullen strength and other physical sheet attributes. Accordingly, a fluff pulp sheet made in accordance with the present invention should have low shred energy while possessing high shred quality which results in significantly reduced fiberization energy when the sheets are ultimately processed. The invention is especially useful for the production of fluff pulp intended for use as the absorbent layer in disposable diapers, sanitary napkins, absorbent hygienic products and airlaid products.

Absorbent products employing fiberized wood pulp have been available for many years. This basic wood pulp used in such products is usually termed "fluff pulp." In the United States, fluff pulp is most typically made from a fully bleached southern pine kraft process pulp produced in relatively heavy caliper, high basis weight sheets. The product is rewound into continuous rolls for shipment to the customer. Since the roll product is intended to be later reprocessed into individual fibers, low sheet strength is desirable and typically little or no refining is used prior to roll manufacturing. The requirements for surface uniformity and formation are similarly moderate.

At the customer's plant, the rolls are continuously fed into a device, such as a hammermill, to be reduced as much as reasonably possible to individual fibers. Defibration is the process of freeing the fibers from each other before the fluff pulp enters the product forming machinery. The fiberized product is generally termed a cellulose "fluff." For example, the fluff pulp can then be continuously air laid into pads for inclusion in the intended product. The most demanding application of fluff pulps is in producing air-laid products, used, for example, in serving utensils and various towel applications in homes, industry and hospitals. As is mentioned above, fluff pulp sheets for air-laid products are usually defiberized in a hammermill. Fluff pulp sheets, however, may contain significant numbers of fiber bundles which are bonded together during the sheeting process. These unwanted fiber bundles, often referred to as knots, nits, bones and flock in the industry, present a problem during defibration. The hammermills used for fluff production are very large energy consumers and fiber bundles present in the fluff pulp sheets will increase the amount of energy expended during defibration. Also, while vigorous defiberizing can reduce the knot content, it is at the expense of considerable fiber breakage and a high resulting content of very fine dusty material. To offset this problem, the pulp mill may need to add chemical debonders prior to sheet formation. Therefore, important parameters that are considered for dry defibration are shredding energy, i.e., the amount of energy needed to shred the sheet and knot content, i.e., the amount of clumps of fibers bonded to each. In heavy manufacturing operations, reduction in energy consumption will ultimately lead to less costly products. Moreover, many manufacturers require high quality fluff pulp to be used in their products due to customer demands. Accordingly, manufacturers of fluff pulp sheets are concerned in creating sheets having low shredding energy while still providing high quality fluff. Lower quality fluff pulp sheets cannot be used in certain applications and as such are often discounted for use in manufacturing lower quality products.

Wood pulp softness can be expressed in terms of properties such as Mullen strength (the strength of pulp or a pulp product, measured in kilopascals (kPa)), and Kamas energy (the energy required to convert a given amount of pulp or pulp product to a fluff material, measured in watt hours per kilogram (Wh/kg)). Mullen strength can be thought of as the energy required to pop a hole in the sheet. Some in the industry refer to this energy as "burst energy." Mullen strength is a good indicator (but not full proof) of the energy needed to shred the sheet (shred energy). Typically, the lower the Mullen strength, the easier it is to shred the fluff pulp sheet. Lower values of Mullen strength and Kamas energy also correlate to softer, increasingly debonded, pulp. While it is desirable to the manufacturer to decrease Mullen strength, it should not be done at the expense of shred quality.

In the art of making fine paper, stock is usually ejected from a device known in the industry as a headbox so as to land gently on the moving fabric loop, known as a forming wire, which moves at a speed typically between plus or minus 3% of the wire speed, called rush and drag respectively. In the manufacture of fluff pulp, the equipment is usually run at about +10% rush. Excessive j/w ratio helps the Mullen strength. Water drains from the stock through the forming wire so that a web is formed on the forming wire. Excessive rush or drag can cause more orientation of fibers of the web in the machine direction and can give differing and sometimes unwanted physical properties in machine and cross directions. Manufacturers, therefore, are concerned about fiber orientation and accordingly have to control the orientation of fibers being deposited on the forming wire in order to achieve the desired physical properties.

As was mentioned above, wood fibers have a tendency to attract to one another, forming clumps, the effect being called flocculation. Flocculation is lessened by lowering consistency and or by agitating the slurry entering or in the headbox. However, defloccullation becomes very difficult at much above 0.5% consistency. Minimizing the degree of flocculation is important to the physical properties of the fine paper or fluff pulp.

Usually, the stock is supplied at extremely high pressure to the headbox by means of pumping equipment and the stock is ejected from the headbox through a device known as slice lip. Accordingly, it is essential that the rate of flow of stock through a distributor tube disposed at one side of the headbox be the same as the rate of flow of stock moving through a distributor tube disposed at the opposite side of the headbox. The rate of flow of stock is usually defined as the number of cubic feet of the stock passing a particular point every minute. It is necessary that the rate of stock flow remain constant or as constant as possible throughout the headbox. The amount of fiber per unit area (basis weight) of the formed web should be ideally constant across the width of the machine and along the machine direction. If the stock has been thoroughly mixed and if the slice lip opening is the same along the entire cross-machine directional width of the headbox, then the weight of the fibers within the stock per inch of width across the ribbon of stock ejected through the slice lip should be substantially constant. The resulting web should then have a uniform basis weight in a cross-machine direction. However, in practice, it is often difficult to maintain a constant stock supply pressure and a uniform consistent in the stock. Accordingly, maintaining an even distribution of fibers within the stock present problems when endeavoring to maintain a uniform basis weight across the width of a formed web.

The manufacturers of fluff pulp also face the problem of maintaining a controlled cross-machine directional basis weight of the formed web. Manufacturers must control the basis weight of the formed web to improve the quality of the end product. Accordingly, the fluff pulp manufacturer must control the basis weight without compromising fiber orientation profile. Additionally, the manufacturer must also be mindful of the need to simultaneously minimize the degree of flocculation in order to attain the desired physical properties of the fluff pulp.

Accordingly, it would be desirable to provide processes for forming fluff pulp sheets having improved bulk, softness and reduced inter-fiber bonding without sacrificing the absorbent properties of the pulp. Also, there has been a need for processes for producing high quality fluff pulp sheets that have significantly lower Mullen strength (burst energy) without losing shred quality. There is also a need to achieve a more uniform basis weight profile without compromising the fiber orientation profile. An improved and more uniform cross-directional weight basis can promote more stable operation in the hammermill and uniform final user product. The novel processes of the present invention fill these and other needs.

SUMMARY OF THE INVENTION

The present invention provides novel processes for the manufacturing of fluff pulp sheets having a reduced number of fiber-to-fibers bonds (fiber bundles) and low variability in weight, moisture, Mullen strength and other physical sheet attributes. Fluff pulp sheets made in accordance with the present invention will possess low shred energy while retaining high shred quality. The present invention also utilizes processes and equipment having dilution control associated with a headbox to achieve a very uniform cross-directional basis weight across the width of the machine to thereby improve the quality of the end product and to run the paper forming equipment with lower headbox consistency. The use of dilution control with the headbox improves the basis weight profile to produce more stable operations in the hammermill and a more uniform final product.

In one particular aspect of the present invention, a pulp slurry made from fluff pulp fibers in an aqueous solution is deposited on the bottom wire (also known as a "forming wire") of a paper manufacturing machine to create a stock web (also referred to as a "mat" in the industry). Due to its nature, the pulp slurry includes both individual fibers and fibers clumped together in fiber-to-fiber bonds forming "fiber bundles." The presence of these fiber bundles is unwanted in the formation of the fluff pulp sheet since these fiber bundles will dry and remain in the finished sheet as unwanted clumps of fibers. Additional energy is usually needed to be expended by the product manufacturer when the fluff pulp sheets are being defiberized due to the presence of these unwanted clumps. Additionally, these fiber bundles reduce the quality of the fluff that will be produced. In one aspect of the present invention, the web is placed on a moving bottom wire and is subjected to high pulsating shear forces which act on the fiber bundles contained in the web to break a majority of them up into individual fibers or smaller sized bundles. The web is later dewatered and dried to produce a fluff pulp sheet having reduced number of unwanted fiber bundles.

In one aspect of the present invention, the web is advanced by the bottom wire and placed in contact with a top forming wire which cooperates with the bottom wire to press some of the liquid from the web. The top forming wire and bottom wire can be, for example, components of a paper forming machine known as a "top former" or "twin wire" machine. In this aspect of present invention, the web is placed between two wires and is subjected to up and down dewatering reducing tendency of fiber to fiber bonding. The use of a top and bottom wire allows the web to be dewatered from two sides, rather than one, which helps to decrease the size of the fiber bundles. The use of top and bottom wires also retains the web within a somewhat confined space to allow the web to be subjected to high pulsating shear forces which act to break up fiber bundles that have formed in the web. The top forming wire former promotes better distribution of the fibers and reduces localized area flock that create uneven strength characteristics to the fluff pulp.

In one aspect of the present invention, a pulsating shear force can be applied to the web in an area where the top forming wire is in contact with the web. The pulsating forces act on the fiber bundles contained in the formed web and are sufficiently large in magnitude to break a majority of these unwanted fiber bundles. The pulsating forces can be applied, for example, to the web in an area where the top forming wire makes contact with the web. The pulsating forces act on the fiber bundles contained in the formed web and are sufficiently large in magnitude to break a majority of these unwanted fiber bundles. Thereafter, the web is fed into a pressing machine which contacts the web to press additional liquid solution from the web. In one particular aspect of the invention, the pressing machine can be a paper forming machine known as a "shoe press." A shoe press can be used since the press provides a larger "nip" area which removes liquid from the web under a lower pressure than conventional roll presses known in the art. The shoe press provides a greater nip area which allows a reduced pressure force to be applied to the fluff pulp stock web as it moves through the pressing machine. Since the fluff pulp stock web has a greater thickness than conventional fine paper stock, the shoe press allows for reduced forces which helps to prevent compression of the pulp fibers while still providing substantial dewatering capabilities. A single shoe press or multi shoe presses in series could be implemented for dewatering purposes. The shoe press could be combined with other pressing machines, such a roll presses, to progressive dewater the web. Lastly, after the web has been dewatered by the respective pressing machines, heat can be applied to the web (via driers) to evaporate additional liquid from the web.

In another aspect of the present invention, a vacuum can be applied to the web when the pulsating shear forces are being applied to the web. The vacuum can be applied at the same location where the pulsating shear forces are being applied to the web to increase the shearing action imparted on fiber bundles contained in the web. This increased shearing force created by the vacuum helps in the breaking of the fiber-to-fiber bonds found in the formed web.

In another aspect of the present invention, the pulp slurry can be deposited on the bottom wire using a headbox which has dilution control. In this particular aspect of the invention, a liquid, such as water, could be selectively added to the pulp slurry to adjust the consistency of the slurry being deposited on the bottom wire in allow the manufacturer to adjust the cross-directional basis weight of the web being formed. In this regard, a more uniform cross-machine directional weight basis can be attained without compromising fiber orientation.

In other aspects of the invention, more than one type of pulp slurry could be utilized to create a fluff pulp sheet having multiple layering. Additives, such as a colorant, could be added to the slurry(es) in other aspects of the invention. A multiple layering headbox with or without dilution control could be used to deposit the stock slurry on the bottom wire. Alternatively, multiple headboxes with or without dilution control could be used to create the multilayered fluff pulp sheet with additives. After the web has been subjected to the pulsating shear forces, it can be further dewatered in pressing equipment such as a shoe press or a series of shoe presses. In another aspect of the invention, additional pressing equipment such as roll presses could be used with the shoe press to further dewater the web.

Other features and advantages of the present invention will become more apparent from the following detailed description of the invention, when taken in conjunction with the accompanying exemplary drawings.

BRIEF DESCRIPTION OF THE DRAWINGS

FIG. 2 is a schematic drawing showing an enlarged image of the top former or twin wire machine depicted in FIG. 1 which can be used to apply the pulsating shear forces on the stock web as it is being advanced to the downstream dewatering machines.

FIG. 3 is a schematic drawing which depicts the top and bottom blades of the top former of FIG. 2 in greater detail.

FIG. 6 is a flow diagram which depicts alternative processes and machinery which can be used in forming fluff pulp sheets in accordance with the present invention.

FIG. 7 is a schematic drawing showing multi layered fluff pulp sheets which can be formed using the processes of the present invention.

FIG. 8 is a schematic drawing showing alternative multilayered fluff pulp sheets with additives which can be formed using the processes of the present invention.

DETAILED DESCRIPTION OF THE PREFERRED EMBODIMENTS

Figure 1:
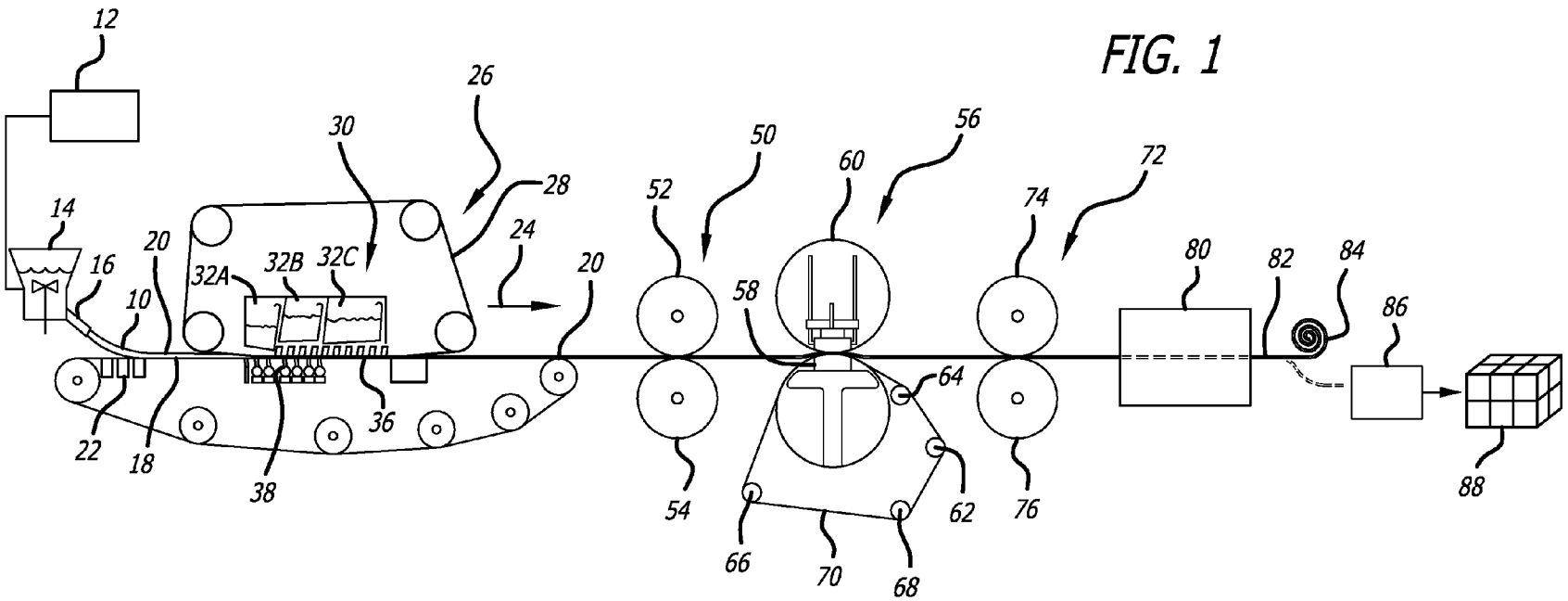
FIG. 1 is a schematic drawing of a process of forming a continuous fluff pulp sheet in accordance with the present invention.

FIGS. 1-3 show with schematic figures one particular process in accordance with the present invention for forming fluff pulp sheets. In accordance with the process depicted in FIG. 1, a pulp slurry 10 is delivered from stock container 12 to a headbox 14. The stock container 12 holds the processed pulp slurry after it has been prepared utilizing known techniques in the art. As noted above, the pulp slurry 12, also referred to as "pulp stock," may typically include cellulose fibers such as chemically digested wood pulp fibers as its main component which is suspended in water or a water-based liquid solution. The slurry may also include as a minor component, mechanical wood pulp and synthetic or other non-cellulose fibers, chemical surfactants and other elements known in the paper making art. Preferably, but optionally, the pulp slurry has undergone a bleaching process to create white fluff pulp stock. The pulp slurry exits the headbox 14 through an opening of adjustable height called the slice 16 and is carefully deposited so as to land gently onto a moving fabric loop, herein referred to as the bottom forming wire 18 which may be found on conventional Fourdrinier machines or "top former" or "twin wire" machines which include a second wire which contacts the web (discussed in greater detail below).

The term "wire" is well known in the art and generally refers to a specially woven plastic or fabric mesh conveyor belt which is used to create a continuous paper web that transforms the source of wood pulp into a sheet of paper. It should be appreciated that many different types of wires could be used in accordance with the processes of the present invention.

It should be appreciated that the bottom forming wire 18 is shown schematically since any one of a number of paper forming equipment could be implemented in accordance with the present invention. The pulp slurry is deposited at a speed typically about plus 10% rush. The higher rush percentage helps to produce a suitable Mullen strength in the fluff pulp. Water drains from the stock through the forming wire so that a web 20 is formed on the bottom forming wire. Excessive rush or drag will cause more orientation of fibers of the web 20 in the machine direction and typically creates very poor contact between fibers which would produce in fine paper manufacturing differing and sometimes unwanted physical properties in the machine and cross directions of the fine paper, but with fluff pulp will reduce shredding energy and fiber to fiber bonds. Manufacturers, therefore, are concerned about fiber orientation and accordingly have to control the orientation of fibers being deposited on the forming wire in order to achieve the desired physical properties.

To achieve a better cross direction weight basis, the process of the present invention utilizes a headbox 14 may include dilution controls (not shown) which allow the operator to dilute the consistency of the pulp slurry as it exists the headbox 14 and is deposited onto the bottom wire 18. Accordingly, the headbox 14 would include dilution lines (not shown) or other liquid supply equipment for controlling the dilution of the pulp slurry flowing through the headbox in order to control the cross-machine direction basis weight of the web 20 that is being produced. The use of dilution control associated with the headbox 14 achieves a very uniform cross-directional basis weight across the width of the machine to thereby improve the quality of the end product and allows the manufacturer to run the equipment with lower headbox consistency. This part of the process allows the slurry of pulp fibers to be filtered out onto the continuous bottom forming wire 18 to form a wet web of fiber having a specific basis weight. In this manner, the present invention is capable of controlling the basis weight of the formed web to improve the quality of the end product. This aspect of the present invention thus controls the basis weight without compromising fiber orientation profile.

The stock web 20 which is initially deposited on the bottom wire 18 is quite soft and wet due to the presence of a high amount of the liquid making up the pulp slurry. Accordingly, as is known in paper-making art, the liquid must be drained from the web 20 (referred to as "dewatering") in order to ultimately produce a dry fluff pulp sheet. In this regard, drainage units 22 can be located under the table where the web 20 is initially deposited on the bottom wire 18 to allow liquid to drain through the small openings formed in the bottom wire 18. However, these drainage units 22, which may include vacuum or suction devices to draw out the liquid, are not capable of completely drying the web 20. Additional drying equipment must be used to progressively dewater the stock web 20. The web 20 moves along with the bottom wire in the direction depicted by arrow 24. The web 20 is the fed into a top former 26 which includes a second top forming wire 28 that contacts the top of the web 20 and, in conjunction with the bottom wire 18, helps to press additional liquid from the wet web 20. The web 20 entering the top former 26 typically has a dryness of about 2-4%.

As can be best seen in FIG. 2, the top wire 28 converges with the bottom wire 18 along a length of the top former 26 to allow sufficient pressing forces to be attained to press some of the liquid from the web 20. Additionally, the top former 26 has dewatering chambers 30 which include vacuum sources (not shown) that draw liquid from the web 20 passing over the vacuum into individual storage containers 32A-32C. The vacuum (depicted by arrows in FIGS. 2 and 3) for the first container 32A can be run at a lower rate than the later containers 32B and 32C. For example, the vacuum associated with container 32A could run at about 5-10 kPa. The vacuum associated with the second container 32B could run at about 5-20 kPa. Lastly, the vacuum associated with the third container 32C could be run at about 10-25 kPa. It should be appreciated that the number of containers and the vacuums associated with each container can vary depending upon the weight basis of the fluff pulp sheet being created. Additionally, one or more suction boxes 34 could be placed below the bottom wire 18 to draw liquid from the web 20 as well. Typically, the web 20 would leave the top former 26 at about 8-14% solids.

The top wire 28 of the top former 26 and bottom wire 18 converge together by utilizing a set of top blades 36 located beneath the dewatering chambers 30 along with preferably a set of bottom loadable blades 38 located directly beneath the bottom wire 18. These blades 36 and 38 can be made from materials such as ceramics. These loadable blades 38 (the loading element) are designed to move the bottom wire 18 upward so that the top wire 28 comes in contact with the top blades 36. This and vacuum between blades 36 results in a pinching effect which causes some of the liquid to be squeezed from the web 20 and forming a fiber layer against top wire 40 which is separate from formed layer in the bottom 42. These separately formed layers have a low tendency of fiber to fiber bonding. As can best be seen in FIG. 3, the top blades 36 are generally stationary while the bottom blades 38 are movable. The placement of the bottom blade 38 between adjacent top blades 36 causes the top and bottom wires to move in an acute upward and downward motion which creates the strong pulsating shear forces that are, in turn, transferred to the web 20 as it passes through the top former 26. These strong pulsating shear forces are designed in order to break the many fiber bundles present in the wet web. Since the web 20 has a high state of wetness when entering the top former 26, any fiber bundles contained in the web are still very susceptible to shear forces which can break the fiber-to-fiber bonds. A suitable device which utilizes top and bottom blades for loading the top and bottom wires of a top former is disclosed in U.S. Pat. No. 5,695,613, which is incorporated in its entirety herein.

It should be appreciated that in the art of forming fine paper stock, a very low load is normally applied by the bottom blades 38 during the squeezing or dewatering process since medium or high pulsating shear forces could be detrimental to the thin stock web being formed on the top former. However, as is discussed in greater detail below, high pulsating shear forces are desired in the processes of the present invention since the pulp slurry forming the web 20 contains many fiber-to-fiber bonds. The pulp slurry contains numerous pulp fibers which cannot possibly be free of fiber-to-fiber bonds as the slurry exits the headbox 14. The dilution of the pulp slurry may lead to some of the fiber bundles being broken as the slurry exits the headbox. However, there may still be many fiber-to-fiber bundles which will be dispersed within the stock web. Also it is known in art of paper making that fibers have a tendency to create fiber-to-fiber bundles in stock. For these reasons, the number of fiber bundles remaining in the stock web 20 is of great concern to the fluff pulp manufacturer. Accordingly, some manufacturers suggest mechanical steps or chemical treatment to be employed during the time that the pulp slurry is first being processed to reduce the number of fiber bundles that enter the headbox. For example, in U.S. Pat. No. 6,059,924, a process is disclosed in which the pulp slurry is mildly refined prior to the step of sheet formation. Such a process requires additional equipment to be used to refine the pulp slurry before it enter the headbox. Other methods to deal with the problem of unwanted fiber bundles require chemical additives to be added to the pulp slurry. However, these processes can lead to additional costs in manufacturing the fluff pulp sheet.

The processes of the present invention utilize high pulsating shear forces which break up the fiber bundles once the web 20 has been deposited on the bottom wire 18. In this regard, the blades 36 and 38 of the top former provide one type of suitable mechanism which is capable of producing cyclical, pulsating shear forces which act on the web 20 as it passes over the blades. The pulsating shear force is usually non-uniform which causes the web 20 to undergo extreme fluctuations of shear forces to help to break any type of fiber-to-fiber bonds that are dispersed in the web. The timing of the application of these high pulsating shear forces occurs when the web 20 is still very wet (only about 2-4% dry) since bonds in wet slurry are easier to break with applied pulsating forces.

As can be seen in FIG. 3, the bottom blade 38 is pushed upward to nearly between two top blades 36 to place a considerable force on the web 20 as it passes over this region of the top former. This creates an acute, upward and downward motion which produces the pulsating shear force that is applied to the web 20. As can be further seen in FIG. 3, the web 20 has a thinly dried upper surface 40 and lower surface 42 with a middle portion 44 that remains substantially in a fluid state as the web 20 passes along the blades 36 and 38. The combination of the vacuum (depicted by arrows inn FIG. 3) in the dewatering chambers 30 combines with the pulsating shear forces produced by the top and bottom blades 36 and 38 to create shear forces that are strong enough to break most, if not all, of the fiber bundles present within the thin upper and lower surfaces 40 and 42 along with the fluid middle portion 44. However, the integrity of the fluff pulp sheet will not be effected by the pounding it receives during this portion of the process since the placement of the top wire 28 and bottom wire 18 helps to maintain the web 20 intact as it moves through and eventually exits the top former 26. As the web 20 proceeds to the next dewatering equipment, a significant amount of solution has been removed from the web 20, but more importantly, a significant amount of the fiber-to-fiber bundles have been broken, which will result in a more uniform fluff pulp sheet. After top former web 20 dryness is high enough that it avoids fibers to move freely relative to each other avoiding new flock formation.

The dewatering in the dewatering chambers 30 will form a fiber layer 40 against top wire which is separate to layer formed on bottom wire 42 with drainage units 22. As these layers are formed separately the fibers are not tangled together due the fluid middle portion 44, the fiber-to-fiber bonding is reduced compared to traditional sheet which has only one direction dewatering during forming. Two layered forming additionally will reduce size and number of the fiber bundles like does the shear effect with loading elements. These effects will reduce energy required to break the web in to individual fibers in Hammer mill or similar equipment.

After the web 20 exits the top former 26, it still has considerable wetness and needs to be dewatered by additional dewatering machines. As can be seen in FIG. 1, the web 20 initially enters a roll press 50, illustrated in this case as two sets of felted calendar rolls 52, 54, each defining a respective nip through which the web 20 passes. After exiting the first roll press 50, the web 20 enters a shoe press 56 which is schematically shown as including a pair of rollers 60 and a movable shoe 58 that places a loading force on the web 20. The shoe press includes rollers 62-68 which are used to advance a felt belt 70. The shoe press is particularly useful in the dewatering process since the shoe 58 can be designed to have a larger contact area (nip) than conventional roll presses. Accordingly, the larger nip of the shoe press allows more contact surface, longer dwell time in the nip, with the web 20 resulting in greater drainage of liquid from the web. Additionally, due the larger surface area of the shoe press, a smaller peak pressure during the nip is required to be applied by the shoe. Since the thickness of the web can be quite large, pulp manufacturers would prefer not to squeeze the web too much since the fiber mat can become compressed during the dewatering process. The shoe press 56 thus helps to prevent unwanted compression of the web. The web 20 then exits the shoe press 56 and can enter into another pressing machine such as another roll press 72, again illustrated as two sets of calendar rolls 74, 76, each defining a respective nip through which the web 20 passes.

From the dewatering section, the web enters a drying section 80 of the fluff pulp manufacturing line. In a conventional fluff pulp sheet manufacturing line, drying section 80 may include multiple cylinder or drum dryers with the web 20 following a serpentine path around the respective dryers and emerging as a dried sheet or mat 82 from the outlet of the drying section. Alternate sides of the wet web 20 will be exposed to the hot surfaces as the web 20 passes from cylinder to cylinder. In most cases, the fluff pulp web 20 is held closely against the surface of the dryers by a fabric having carefully controlled permeability to steam and air. Heat is transferred from the hot cylinder to the still wet web, allowing some of the remaining liquid to be evaporated. Other alternate drying equipment, alone or in addition to cylinder or drum dryers, may be included in the drying process. Typically, the dried pulp sheet 82 emerging from the drier section has an average maximum moisture content of no more than about 5% by weight of the fibers, more preferably no more than about 6% to 10% by weight and most often about 7%.

In the FIG. 1 embodiment, the dried sheet 82 is taken up on a roll 84 for transportation to a the fluff pulp processing equipment where the sheet can be defiberized for use in manufacturing fluffed pulp absorbent products. Alternatively, the dried sheet 82 can be collected in a baling apparatus 86 from which bales 88 of individual fluff pulp sheets are created and bundled together.

Figure 4:
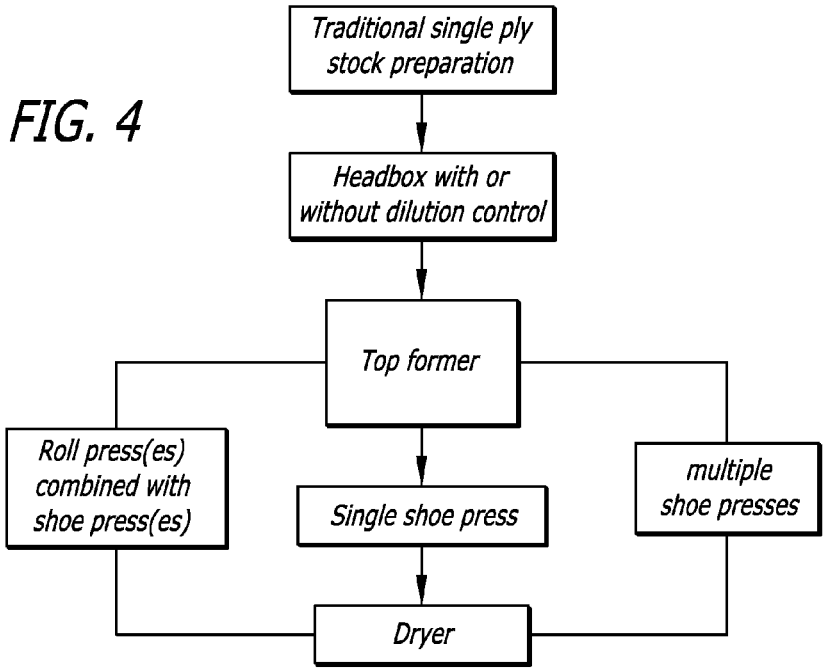
FIG. 4 is a flow diagram which depicts the processes and machinery which can be used in forming fluff pulp sheets in accordance with the present invention.

Referring now to FIG. 4, a flow chart shows the sequence of steps that can be performed in forming a fluff pulp sheet in accordance with the processes of the present invention. Initially, a pulp slurry can be prepared utilizing traditional single ply stock techniques which are well known in the art. The stock preparation could optionally include the bleaching of the wood pulps using known bleaching methods, including for example and without limitation those described in U.S. Pat. No. 6,893,473. Next, the pulp slurry is delivered into a headbox which may or may not include dilution controls to dilute the concentration of the slurry as it is being delivered onto the bottom wire. The bottom wire and top wire can be a part of a top former machine well known in the art. The top former can be set to apply a high pulsating shear force on the stock web. The web formed on the bottom wire can then be advanced into a number of different machines and combinations of machines to assist in dewatering the web. For example, a single shoe press could be used to dewater the web. Another alternative is to use multiple shoe presses in series to progressively dewater the web. Another alternative is to use one or more roll presses with a single shoe press. The dewatering process could use single or multiple roll presses and shoe presses to progressively dewater the web. Any of the presses can be single or double felted. Accordingly, there are numerous ways associated with the processes of the present invention to effectively dewater the formed web. Lastly, the web would exit the dewatering machinery to advance the web into a dryer section. As is mentioned above, the dryer section can be created utilizing a number of different drying equipment well known in the art, such as cylindrical driers, which help to promote better separation of the fibers and to reduce bonding of the fibers resulting in a lower Mullen strength.

Figure 5:
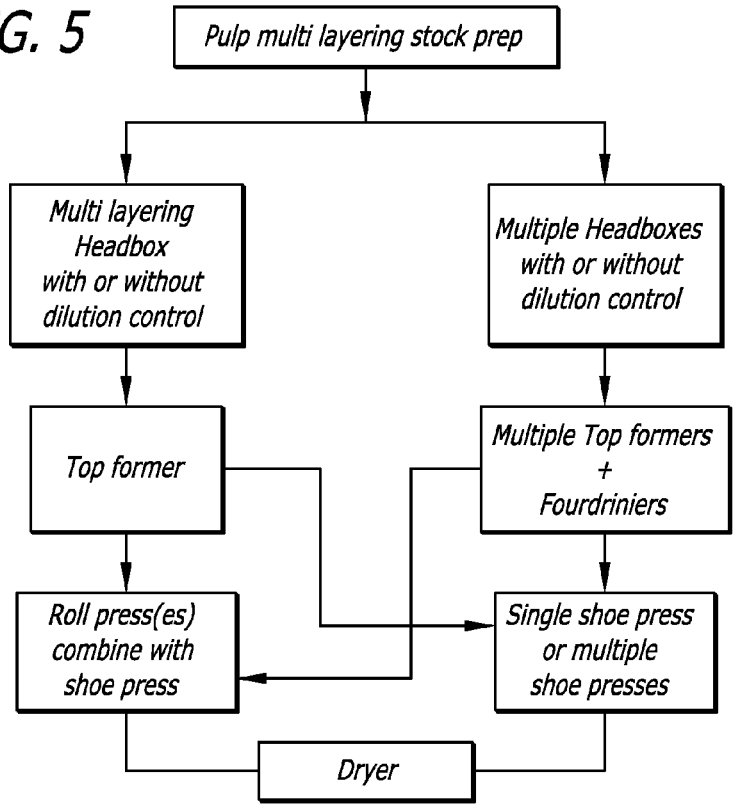
FIG. 5 is a flow diagram which depicts alternative processes and machinery which can be used in forming fluff pulp sheets in accordance with the present invention.

Referring now to FIG. 5, another flow chart shows the sequence of steps that can be performed in forming fluff pulp sheets in accordance with the processes of the present invention. Initially, multiple pulp slurries are prepared utilizing multilayering stock preparation. Such techniques are well known in the art. The stock preparation could optionally include the bleaching of the wood pulps using known bleaching methods, including for example and without limitation those described in U.S. Pat. No. 6,893,473. Next, the pulp slurries are delivered into a headbox which may or may not include dilution controls. If dilution controls are available, the concentration of the slurries can be diluted as the slurries are being deposited on the bottom wire. Alternatively, the pulp slurries could be delivered to multiple headboxes with or without dilution. An individual headbox could be used to deposit a particular slurry to the bottom wire. A top former machine could be used as is described in greater detail above to break many of the fiber bundles dispersed thoughout the stock web. The multiple slurries contained in multiple headboxes could be deposited on multiple top formers and Fourdriniers. The resulting webs formed by either of these processes could then be dewatered utilizing, for example, a single shoe press or multiple shoe presses in series. Multiple roll presses could be used as well. Any of the presses can be single or double felted. The web would then exit the dewatering machinery and be advanced into a dryer section as is disclosed above.

FIG. 7 shows a schematic which depicts a multilayered fluff pulp sheet 90 which include a top section 92, a middle section 94 and a bottom section 96. The top and bottom sections 92 and 96 can be made, for example, from the same fluff material while the center section could be made from a different fluff material. All of the layers could be made from different stock as well. The fluff pulp sheet can be made with any number of layers. Accordingly, it should be appreciated that there can be a number of different combination of layers and the composition of the layers that can be created using the processes disclosed herein.

Referring now to FIG. 6, another flow chart shows the sequence of steps that can be performed in forming fluff pulp sheets made with additives. Initially, multiple pulp slurries are prepared with additives, such as coloring, debonding, odor-control, static control and the like, using additive multilayering stock preparation techniques well known in the art.

Next, the pulp slurries are delivered into a multilayering headbox which may or may not include dilution controls to dilute the concentration of the slurries as they are being delivered onto the bottom wire. The slurries can then be deposited on a bottom wire of a top former machine. The resulting webs could then be dewatered utilizing the dewatering equipment disclosed in the previous charts. For example, a single shoe press or multiple shoe presses in series could be used to dewater the web. Alternatively, multiple roll presses and a single shoe press or multiple shoe presses could be used to dewater the web. Lastly, the web would exit the dewatering machinery and be advanced into a dryer section. Of course, such additives mentioned above could optionally be applied to the web in addition to, or alternatively, at any stage, embodiment, or objective of the fluff pulp sheet making process described herein below or herein above, including without limitation surface applications including without limitation spray, coating, or the like surface applications.

FIG. 8 shows a schematic which depicts an additive multilayered fluff pulp sheet 100 which include a top section 102, a middle section 104 and a bottom section 106. The top and bottom sections 102 and 106 can be made from the same fluff material and the same additives while the center section 104 could be made from the same or a different fluff material. The additives of this center section 104 could be different from those used in the top and bottom sections. The fluff pulp sheet can be made with any number of layers, each layer having different or similar additives. Accordingly, it should be appreciated that there can be a number of different combination of layers and additives added to a particular layer using the processes disclosed herein.

The various equipment which can implemented to achieve the various processes described herein are generally commercially available. For example, a simple headbox which can be utilized can be Model Valley manufactured by Voith Paper. A suitable headbox with dilution controls includes Model SymFlo manufactured by Metso Paper and Model Valley manufactured by Voith Paper. A suitable multilayering headbox includes Model SymFlo manufactured by Metso Paper. The top former used to apply the pulsating force and vacuum to the formed web include Model MB manufactured by Metso and Model PFI manufactured by Johnson Foils. Suitable shoe presses include Model OptiPress manufactured by Metso Paper and Model NipcoFlex manufactured by Voith Paper. Roll presses that can be used include Model Combi Press manufactured by Beloit. The drying equipment includes suitable equipment such as Model SymDry manufactured by Metso Paper and Model Airborn manufactured by Andriz.

Generally, any fluff pulp or fluff pulp fiber is suitable for use in the present application, and the selection thereof is within the skill of one knowledgeable in the fluff pulp and fluff pulp fiber arts. The type of fluff pulp or fluff pulp fiber suitable for use herein is not intended to be limiting. Fluff pulp typically includes cellulosic fiber. The type of cellulosic fiber is not critical, and any such fiber known or suitable for use in fluff pulp paper can be used. For example, the fluff pulp can made from pulp fibers derived from hardwood trees, softwood trees, or a combination of hardwood and softwood trees. The fluff pulp fibers may be prepared by one or more known or suitable digestion, refining, and/or bleaching operations such as, for example, known mechanical, thermomechanical, chemical and/or semichemical pulping and/or other well-known pulping processes. The term, "hardwood pulps" as may be used herein include fibrous pulp derived from the woody substance of deciduous trees (angiosperms) such as birch, oak, beech, maple, and eucalyptus. The term, "softwood pulps" as may be used herein include fibrous pulps derived from the woody substance of coniferous trees (gymnosperms) such as varieties of fir, spruce, and pine, as for example loblolly pine, slash pine, Colorado spruce, balsam fir and Douglas fir. In some embodiments, at least a portion of the pulp fibers may be provided from non-woody herbaceous plants including, but not limited to, kenaf, hemp, jute, flax, sisal, or abaca, although legal restrictions and other considerations may make the utilization of hemp and other fiber sources impractical or impossible. Either bleached or unbleached fluff pulp fiber may be utilized. Recycled fluff pulp fibers are also suitable for use. When bleached, any bleaching method is suitable, including for example and without limitation those described in U.S. Pat. No. 6,893,473. The fluff pulp and fluff pulp fibers may be treated or untreated, and they may optionally contain one or more than one additives, or combination thereof, which are known in the art. Given the teachings herein, the level of treatment, if desired, and the amount of additives may be readily determined by one of ordinary skill in the fluff pulp and fluff pulp fiber arts.

In the broad aspects of the present invention, it is also contemplated that the pulp may be treated with bond-inhibiting chemical substances, debonders as they are commonly called, chemical softeners, or other chemical additives during preparation of the fluff pulp sheet to alter processing or aesthetic characteristics of the finished fluff pulp or finished fluffed pulp and the absorbent products made from said fluffed pulp. The addition of such chemicals is normally effected by adding the chemical to the pulp prior to sheet formation in multi or single layers or by spraying the pulp after the formation of the non-woven web and sometimes during initial mechanical dewatering. Included within such materials are fatty acid soaps, alkyl or aryl sulfonates, quaternary ammonium compounds and the like. Usually, such materials would be used in an amount of below about 0.5% by weight and often below about 0.1% by weight of dry pulp.

As discussed herein, if desired, additives such as pH adjusting agent, whitener, colorant, odor-control, pigment, optical brightening agent, wetting agent, binder, bleaching agent, trivalent cationic metal, alum, other additive, or a combination thereof may be utilized. Such compounds are known in the art and otherwise commercially available. Given the teachings herein, one of ordinary skill in the fluff pulp and fluff pulp papermaking arts would be able to select and use them as appropriate. If present, the amount of additive is not particularly limited. Of course, such additives mentioned above could optionally be applied to the web t any stage, embodiment, or objective of the fluff pulp sheet making process described herein below or herein above, including without limitation surface applications including without limitation spray, coating, or the like surface applications.

The dried sheet of fluff pulp fibers typically has a thickness of about 20 to 80 mils, a basis weight of 200 to 900 g/m.sup.2, a burst index of 0.5 to 3.0 kPa.multidot.m.sup.2/g. The dried pulp sheet generally has a density of about 0.3 to about 1.0 g/cm.

In one embodiment, the additive may be present in amounts ranging from about 0.005 to about 50 weight percent based on the weight of the fluff pulp sheet. This range includes all values and subranges therebetween, including about 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, and 50 weight percent, or any combination thereof, based on the weight of the finished fluff pulp sheet.

In one embodiment, the fluff pulp sheet may have a basis weight ranging from 100 to 1100 gsm. This range includes all values and subranges therein, for example 100, 125, 150, 175, 200, 225, 250, 275, 300, 400, 500, 600, 700, 800, 900, 1000, 1100, or any combination thereof or range therein.

The fluff pulp sheet made in accordance with the present invention can be made into a number of different products. These products include, but are not limited to, absorbent products, paper products, personal care products, medical products, insulating products, construction products, structural material, cement, food products, veterinary products, packaging products, diaper, tampon, sanitary napkin, incontinent pads, absorbent towels, gauze, bandage, fire retardant, and combinations thereof.

Numerous modifications and variations on the present invention are possible in light of the above teachings. It is, therefore, to be understood that within the scope of the accompanying claims, the invention may be practiced otherwise than as specifically described herein.

We claim:

1. A process for making a fluff pulp sheet, comprising:

creating a pulp slurry which includes fluff pulp fibers suspended in a liquid, the pulp slurry containing multiple fiber bundles formed from fluff pulp fibers which are bonded together and dispersed within the pulp slurry;

applying an amount of the pulp slurry onto a moving bottom forming wire to form a web thereon, the pulp slurry being dispensed by a headbox;

applying a top forming wire onto the web and dewatering the web through the top forming wire;

applying high pulsating shear forces on the web sufficiently large to break some of the fluff pulp fiber bundles using a top set of blades and a bottom set of blades, at least one of the top set of blades and bottom set of blades being movable, the top set of blades adapted to contact the top forming wire and the bottom set of blades adapted to contact the bottom forming wire, movement of the at least one of the top and bottom sets of blades causing the web to move in an acute upward and downward fashion, wherein the bottom blades move the bottom forming wire upward causing the top forming wire to come into contact with the top set of blades; and controlling the cross-directional weight basis of the web by varying the concentration of the pulp slurry being deposited from the headbox onto the bottom forming wire.

2. The process in claim 1, further including:

dewatering the web through the bottom forming wire to create a bottom fiber layer against the bottom forming wire.

3. The process in claim 1, further including:

further dewatering liquid from the web after the web has been subjected to the pulsating shear forces.

4. The process of claim 3, wherein the further dewatering is achieved by a roll press located downstream from the top and bottom forming wires and a shoe press located downstream from the roll press.

5. The process of claim 4, wherein the shoe press comprises a nipped shoe press.

6. The process of claim 1, further including:

applying heat to the web.

7. The process of claim 1, wherein liquid is added to the pulp slurry exiting the headbox to adjust the concentration of the pulp slurry prior to being deposited onto the bottom forming wire.

8. The process of claim 1, wherein the top forming wire contacts the web and the pulsating shear forces are applied in a region where the top forming wire and bottom forming wire contact the web.

9. The process of claim 1, wherein a portion of the pulsating shear forces applied to the web is created by subjecting the web to a vacuum source.

10. The process of claim 1, wherein the top forming wire and bottom forming wire are components of a top former apparatus.

11. The process of claim 1, wherein the pulsating shear forces have variable energy.

12. The process of claim 1, further including:

contacting the web with another dewatering machine after the web has been partially dewatered by the top forming wire and bottom forming wire.

13. The process of claim 12, wherein the dewatering machine is a shoe press.

14. The process of claim 1, wherein a bottom blade is positioned on one side of the web and located between adjacent top blades on an opposite side of the web and moves upward nearly between the adjacent top blades so as to cause the web to move in an acute upward and downward motion.

15. The process of claim 14, wherein a portion of the pulsating shear forces applied to the web is created by subjecting the web to a plurality of vacuum sources.

16. The process of claim 15, wherein a first vacuum source nearer to the headbox than a second vacuum source generates less vacuum than the second vacuum source.

17. A process for making a fluff pulp sheet, comprising:

creating a pulp slurry which includes fluff pulp fibers suspended in a liquid, the pulp slurry containing multiple fiber bundles formed from fluff pulp fibers which are bonded together and dispersed within the pulp slurry;

applying the pulp slurry onto a moving bottom forming wire which moves the deposited pulp slurry in a forward direction to form a web, the pulp slurry being dispensed by a headbox;

applying pulsating shear forces of sufficient magnitude on the web to break some of the fiber bundles contained in the web by using a top set of blades and a bottom set of blades, at least one of the top and bottom sets of blades being movable, the top set of blades adapted to contact the top forming wire and the bottom set of blades adapted to contact the bottom forming wire, and the bottom blades move the bottom forming wire upward causing the top forming wire to come into contact with the top set of blades;

contacting the web with a dewatering machine downstream from applying pulsating shear forces, wherein the dewatering machine comprises a shoe press; and adjusting the cross-directional weight basis of the pulp slurry by diluting at least a portion the concentration of the pulp slurry as it is being deposited from the headbox onto the bottom forming wire.

18. The process of claim 17, further including:

monitoring the cross-directional basis weight of the web.

19. The process in claim 17, further including:

applying a top forming wire onto the web and dewatering the web through the top forming wire.

20. The process of claim 17, wherein the shoe press comprises a nipped shoe press.

21. The process of claim 17, wherein a portion of the pulsating shear forces applied to the web is created by subjecting the web to first and second vacuum sources, such that a first vacuum source nearer to the headbox than a second vacuum source generates less vacuum than the second vacuum source.

* * * * *